United States Patent [19]

McCall et al.

[11] Patent Number: 4,865,368

[45] Date of Patent: Sep. 12, 1989

[54] SLIDE LATCH GRAVITY LOCK

[75] Inventors: Melvin D. McCall, Homer; Lawrence D. Greene, Groton, both of N.Y.

[73] Assignee: Smith Corona Corporation, Cortland, N.Y.

[21] Appl. No.: 135,189

[22] Filed: Dec. 17, 1987

[51] Int. Cl.[4] ..... E05C 1/10

[52] U.S. Cl. ..... 292/175; 292/252; 292/DIG. 48; 190/120; 150/101; 70/289

[58] Field of Search ..... 292/252, DIG. 48, DIG. 42, 292/150, 147, 151, 146, 153, 145, 154, 175; 70/289, 69, 70, 386; 190/118, 119, 120; 206/1.5; 150/101; 340/365 R; 312/208

[56] References Cited

U.S. PATENT DOCUMENTS

| | | | |
|---|---|---|---|
| D. 290,468 | 6/1987 | Greene et al. | D18/12 |
| 530,862 | 12/1894 | Teed | 292/150 X |
| 612,572 | 10/1898 | Robertson | 206/1.5 |
| 3,756,639 | 9/1973 | Wilkinson | 292/139 X |
| 3,828,897 | 8/1974 | Scott | 206/1.5 X |
| 4,094,392 | 6/1978 | Gregg et al. | 190/120 |
| 4,346,924 | 8/1982 | Herriott | 206/1.5 X |
| 4,652,029 | 3/1987 | Yamamoto | 292/252 |
| 4,714,286 | 12/1987 | Yamamoto | 292/252 X |
| 4,739,316 | 4/1988 | Yamaguchi et al. | 340/365 R X |
| 4,742,478 | 5/1988 | Nigro, Jr. et al. | 312/208 X |

FOREIGN PATENT DOCUMENTS

| | | | |
|---|---|---|---|
| 2806838 | 8/1979 | Fed. Rep. of Germany | 190/119 |
| 941925 | 1/1949 | France | 206/1.5 |
| 1401589 | 7/1975 | United Kingdom | 190/120 |

*Primary Examiner*—Gary L. Smith
*Assistant Examiner*—Eric K. Nicholson

[57] ABSTRACT

The slide latch gravity lock of the present invention includes means which prevent the lock from opening when the article with which the lock is utilized is in its vertical position. When the article is moved from its horizontal position to a vertical position, a ball located within the lock mechanism moves by gravity from a first position wherein it does not restrain movement of the slide latch to a second position where it does.

5 Claims, 4 Drawing Sheets

SLIDE LATCH GRAVITY LOCK

CROSS-REFERENCES TO RELATED APPLICATIONS

There are no related applications

STATEMENT AS TO RIGHTS TO INVENTIONS MADE UNDER FEDERALLY SPONSORED RESEARCH AND DEVELOPMENT

The invention disclosed and claimed herein was not made under any federally sponsored research and development program.

BACKGROUND OF THE INVENTION (1) Field of the Invention

This invention is directed to an improved slide latch gravity lock for an article which includes novel means that prevent the lock from opening when the article is in its vertical position.

(2) Description of the Prior Art

Various prior art gravity lock mechanisms include the device described in U.S. Pat. No. 4,652,029, "Locking Mechanism for a Case." This patent discloses a carrying case lid having a hook thereon which is located within a container opening in the carrying case body when the carrying case is closed. A ball and an inclined surface on which the ball is free to roll is located within the container.

When the carrying case is closed and in a horizontal position, the ball does not prevent the hook (and the attached carrying case lid) from being moved away from the compartment in the carrying case body. However, when the carrying case is closed and in a vertical position, the ball is wedged between the hook and the compartment, and the hook (and the carrying case lid) is prevented from moving away from the compartment in the carrying case body. Unlike the present invention, the '029 patent does not utilize a sliding latch mechanism and, also unlike the present invention, the locking mechanism of the '029 patent is released automatically when the case is placed in a horizontal position.

Another prior art gravity lock is disclosed in U.S. Pat. No 3,756,639, "Orientation Sensitive Luggage Latch." The purpose of this gravity lock, unlike the purpose of the gravity lock of the present invention is to prevent the luggage from opening when it is in its horizontal, but wrongside-up position. The mechanism of this patent is also significantly different from that disclosed herein. Still another prior art gravity lock is disclosed in U.S. Pat. No. 3,828,899, "Orientation Sensitive Latch," wherein a gravity operated detent mechanism prevents luggage from being opened when in its wrongside-up position.

Other prior art gravity locks are shown in U.S. Pat. No. 530,862, "Lock," wherein a gravity lock prevents the case from being opened when the case is in its horizontal position and U.S. Pat. No. 4,346,924, "Releasable Fastening Device," wherein a briefcase is prevented from being opened when it is in its inverted position.

SUMMARY OF THE INVENTION

The present invention includes a simple, inexpensive slide latch gravity lock for an article which assures that the article will remain locked when the article is carried in its vertical position. When the article is in its horizontal position, the slide latch is free to move so that the article may be opened. When the article is in its vertical position, a ball located within the slide latch gravity lock moves by gravity to a position which restrains movement of the slide latch and the article may not be opened.

BRIEF DESCRIPTION OF THE DRAWING

A further understanding of the present invention may be had when the following detailed description is read in conjunction with the accompanying drawings, in which.

DETAILED DESCRIPTION OF THE PREFERRED EMBODIMENT

Figure 1:
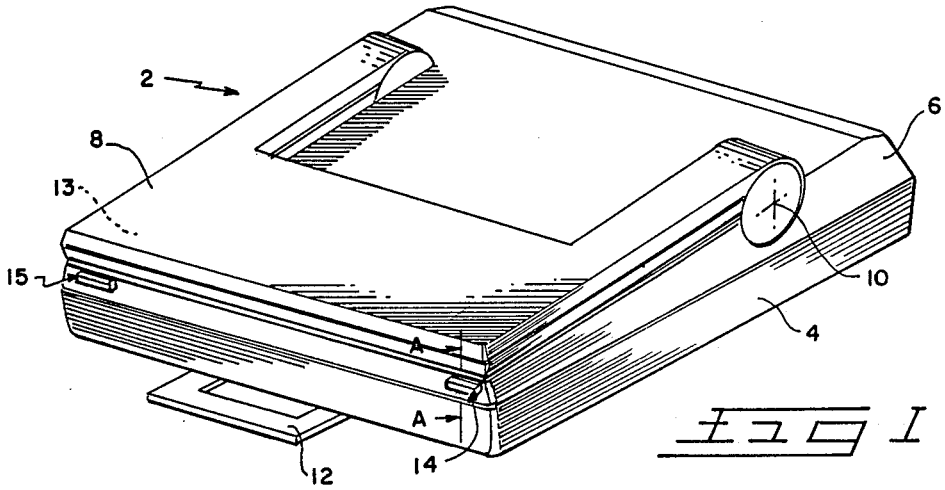
FIG. 1 is a front perspective view of an article of the type in which the improved slide latch gravity lock of the present invention is used.

There is shown in FIG. 1, an article 2 of the type with which the slide latch gravity lock may be used. The article comprises a typewriter 4 having a mask portion 6 secured thereto and a liquid crystal display housing 8 pivotable at its axis 10 about the mask portion 6. A handle 12 enables the article 2 to be conveniently transported.

When the typist wishes to use the typewriter 4, the liquid crystal display housing 8 is pivoted at its axis 10 about the mask portion 6, so that the typist may have access to the keyboard of the typewriter (not shown), and may view the information on a liquid crystal display 13 contained in liquid crystal display housing 8. When the article 2 is closed, the liquid crystal display housing 8 is secured to the mask portion 6 by a slide latch gravity lock, shown generally as 14. A second, identical slide latch gravity lock 15 is located on the opposite side of the handle 12 to also secure the liquid crystal display housing 8 to the mask portion 6.

It should be specifically noted that although the illustrated embodiment shows the use of the slide latch gravity lock 14 to secure the liquid crystal display housing 8 with the mask portion 6, the slide latch gravity lock 14 has equal utility to secure other articles as well. The slide latch gravity lock 14 may, for example, be used to secure a carrying case lid to a carrying case body.

Figure 5:
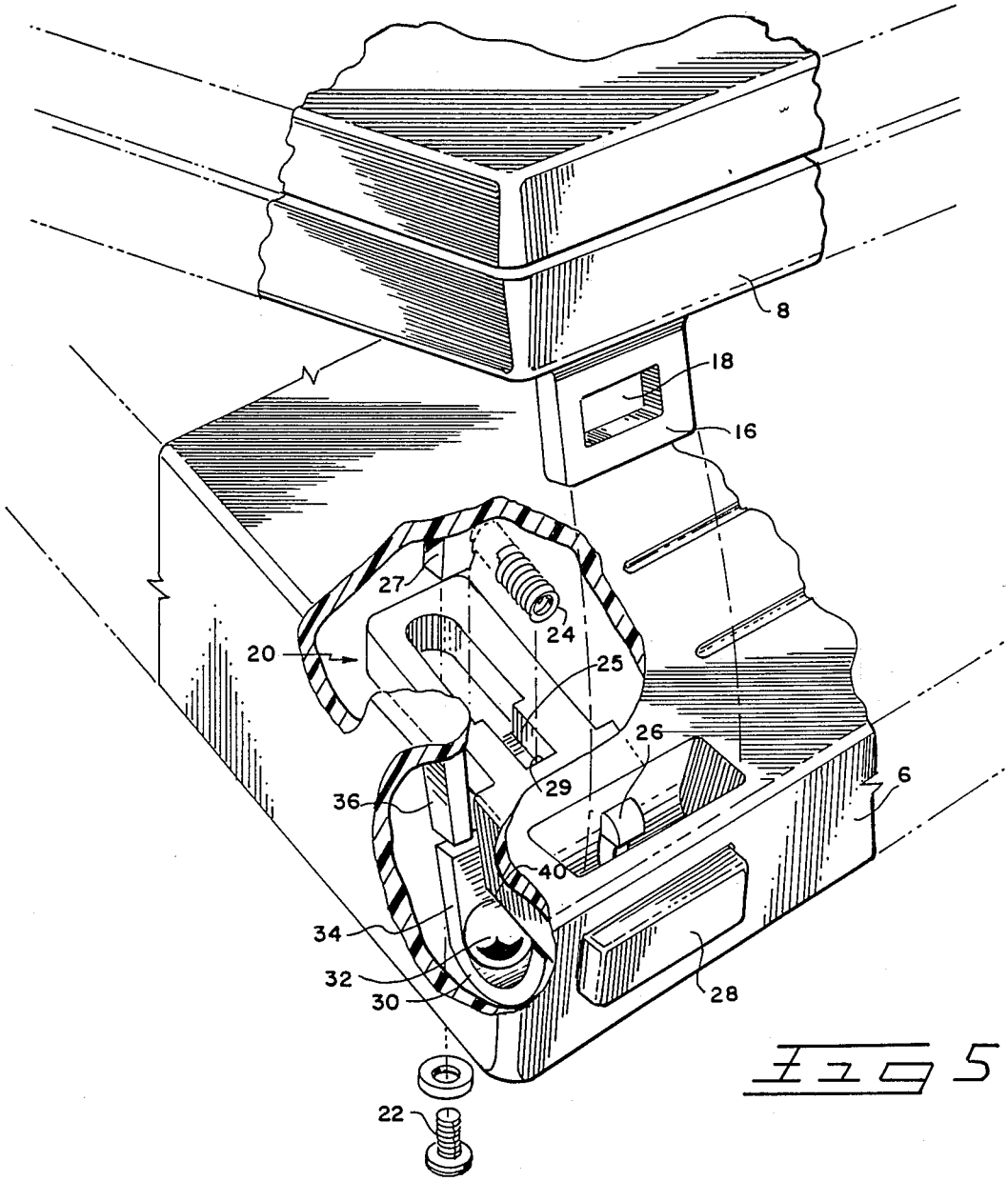
FIG. 5 is a partial sectional perspective view of the improved slide latch gravity lock of the present invention and showing the article in an opened position.

As seen in FIG. 5, wherein the article 2 is shown in an opened position, a fastening device 16 having an eye 18 therein is integral with the bottom surface of the liquid crystal display housing 8. A slide latch 20 is slidably secured to the bottom surface of the mask portion 6 by a screw 22. A compression coil spring 24 is seated in an elongated opening 25 (FIGS. 5 & 6) in the slide latch 20.

The spring 24 has one end abutting against a post 27 integrally formed from the mask portion 6 and has an opposite end abutting against an end wall 29 of the opening 25 of the slide latch 20. The spring 24 biases the slide latch 20 in the direction of the arrow to its initial position. When the liquid crystal display housing 8 is in its closed position (FIG. 2), a hook portion 26 of the slide latch 20 enters the eye 18 of the fastening device 16 to lock the liquid crystal display housing 8 to the mask portion 6 of the typewriter 4.

Figure 2:
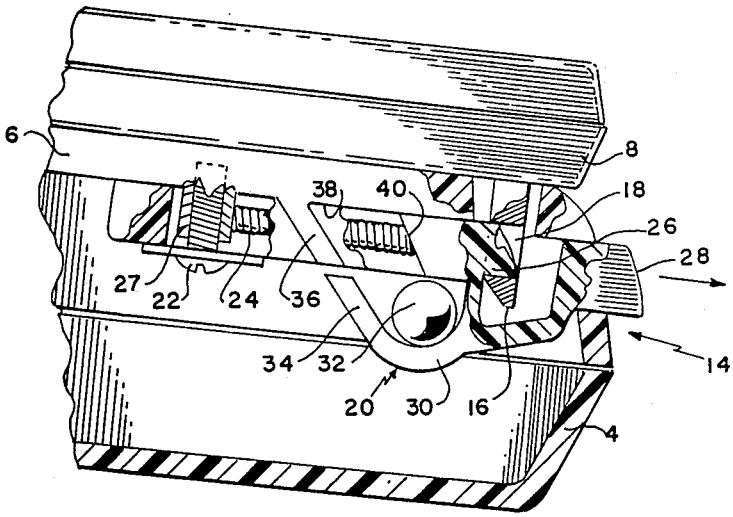
FIG. 2 is a partial sectional view of the improved slide latch gravity lock of the present invention taken along the line A—A of FIG. 1 and showing the article in its horizontal, locked position.

The slide latch 20 also includes a tab portion 28 which, when depressed, causes the slide latch 20 to move in the direction opposite to the arrow shown in FIG. 2. The slide latch 20 also contains a ball housing section 30 within which a ball 32 is housed. An inclined linear portion 34 of the ball housing section 30 is in alignment with an inclined projection 36 integral with the mask portion 6.

Figure 3:
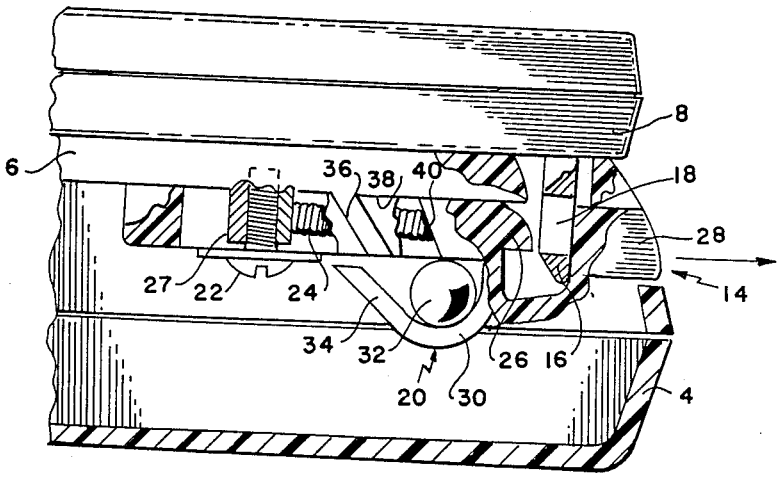
FIG. 3 is a partial sectional view of the improved slide latch gravity lock of the present invention taken along the line A—A of FIG. 1 and showing the article in its horizontal, unlocked position.

When the tab portion 28 of slide latch 20 is depressed, as shown in FIG. 3, the hook portion 26 of the slide latch 20 is withdrawn from the eye 18 of the fastening device 16, thereby unlocking the liquid crystal display housing 8 from the mask portion 6 of the typewriter 4 to allow the article 2 to be opened. When the article 2 is in its horizontal position, as shown in FIGS. 2 and 3, the ball 32 remains in the ball housing section 30 and does not prevent lateral, unlocking movement of the slide latch 20. When the tab portion 28 of the slide latch 20 is released, as shown in FIGS. 2 and 4, the hook portion 26 of the slide latch 20 enters the eye 18 of the fastening device 16 to lock the liquid crystal display housing 8 to the mask portion 6 of the typewriter 4.

Figure 4:
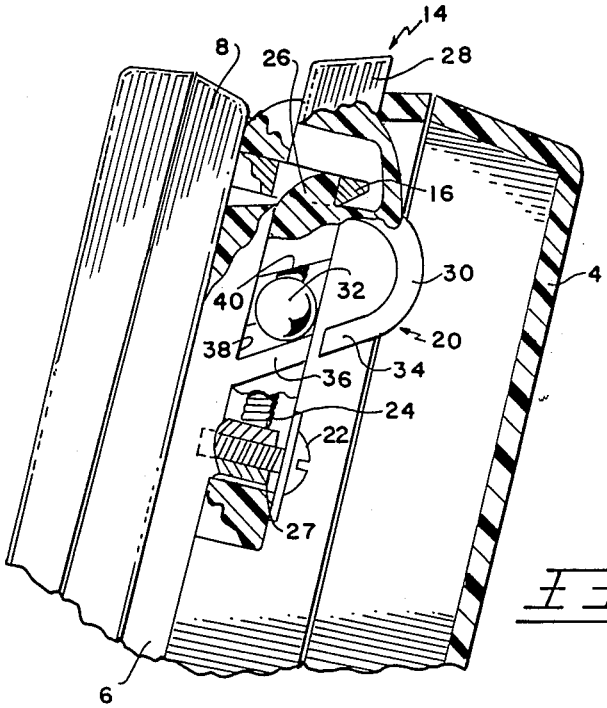
FIG. 4 is a partial sectional view of the improved slide latch gravity lock of the present invention taken along the line A—A of FIG. 1 and showing the article in its vertical position wherein the article may not be unlocked.

When, however, the article 2 is in its vertical position, as shown in FIG. 4, the ball 32 moves by gravity downwardly along the inclined linear portion 34 of the ball housing section 30 and onto the inclined projection 36 of the mask portion 6. The ball 32 is stopped by abutting against a wall 38 of the mask portion 6. The ball 32 is now seated against the wall 38 and the inclined projection 36. In this position, the ball 32 is located in the path of movement of an inclined abutment 40 of the slide latch 20. When the ball 32 is in the position shown in FIG. 4, the ball 32 prevents the lateral, unlocking movement of the slide latch 20 because the abutment 40 on the slide latch 20 is prevented from lateral movement by the ball 32. Thus, when article 2 is in its vertical position, the slide latch 20 is restrained and the article 2 may not be opened.

Figure 6:
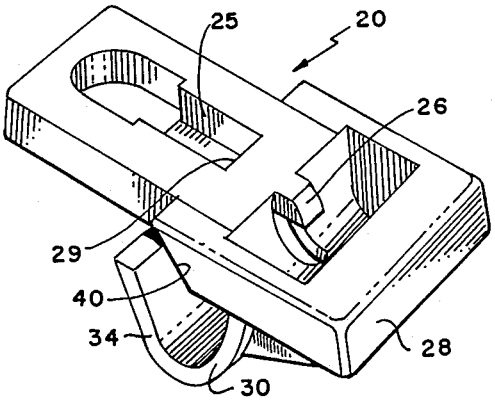
FIG. 6 is a perspective view of the slide latch.

As previously stated, the present invention includes a simple, inexpensive slide latch gravity lock. The slide latch 20, as best shown in FIG. 6, significantly contributes to the simple and inexpensive structure by having the hook portion 26, the ball housing section 30 and the abutment 40 all integrally molded in a single part.

It is to be understood that the present disclosure of a slide latch gravity lock has been made only by way of example, and that changes in details of construction and the combination and arrangement of parts may be resorted to without departing from the true spirit and scope of the invention as hereinafter claimed.

What is claimed is:

1. A slide latch gravity lock for locking first and second portions of an article together, said lock comprising:

a fastening device having an eye therein secured to the first portion of the article;

a slide latch slidably secured to the second portion of the article, said slide latch includes an integrally formed hook fixedly attached to said slide latch which is moveable into and removable from the eye of the fastening device for locking and unlocking the first and second portions when the article is in a horizontal position, an integrally formed ball housing section, and an integrally formed abutment;

a ball supported within said ball housing section when the article is in a horizontal position for allowing said hook to be removed from the eye of the fastening device for unlocking the first and second portions; and means on the second portion for maintaining the ball outside said ball housing section and in the path of said abutment of said slide latch when the article is in a vertical position to cause said abutment to abut against the ball to prevent unlocking movement of said slide latch for locking the first and second portions together.

2. A slide latch gravity lock as recited in claim 1 further comprising a spring for biasing said slide latch to a position for locating said hook into the eye of the fastening device.

3. A slide latch gravity lock as recited in claim 1 wherein said ball housing section includes an inclined linear portion for supporting the ball.

4. A slide latch gravity lock as recited in claim 3 wherein said means for maintaining the ball outside said ball housing section when the article is in a vertical position includes an inclined projection on the second portion which is in alignment with said inclined linear portion of said ball housing section so that when the article is in a vertical position, the force of gravity will cause the ball to roll along said inclined linear portion of said ball housing section onto said inclined projection of the second portion.

5. A slide latch gravity lock as set forth in claim 1 wherein the first portion of the article is a liquid crystal display housing and the second portion is a typewriter mask portion.

* * * * *